US008075149B2

(12) United States Patent
Ko et al.

(10) Patent No.: US 8,075,149 B2
(45) Date of Patent: Dec. 13, 2011

(54) SWITCHED LED NIGHTLIGHT FOR SINGLE-GANG JUNCTION BOX

(75) Inventors: Wai-Shing Peter Ko, Peachtree City, GA (US); James H. Bowden, Jr., Tyrone, GA (US)

(73) Assignee: Cooper Technologies Company, Houston, TX (US)

( * ) Notice: Subject to any disclaimer, the term of this patent is extended or adjusted under 35 U.S.C. 154(b) by 389 days.

(21) Appl. No.: 12/127,780

(22) Filed: May 27, 2008

(65) Prior Publication Data

US 2008/0297060 A1 Dec. 4, 2008

Related U.S. Application Data

(60) Provisional application No. 60/932,157, filed on May 29, 2007.

(51) Int. Cl.
*F21V 33/00* (2006.01)

(52) U.S. Cl. ..... 362/95; 362/800; 315/363

(58) Field of Classification Search ..... 362/448, 362/800, 611–613, 95; 315/312–314, 362, 315/363

See application file for complete search history.

(56) References Cited

U.S. PATENT DOCUMENTS

| | | | | |
|---|---|---|---|---|
| 5,485,356 | A | 1/1996 | Nguyen | |
| 5,637,930 | A | 6/1997 | Rowen et al. | |
| 5,670,776 | A | 9/1997 | Rothbaum | |
| 5,713,655 | A | 2/1998 | Blackman | |
| 5,763,872 | A | 6/1998 | Ness | |
| 5,877,682 | A | 3/1999 | Groeller | |
| 6,072,606 | A | 6/2000 | Huether et al. | |
| 6,087,588 | A | 7/2000 | Soules | |
| 6,149,283 | A | 11/2000 | Conway et al. | |
| 6,288,497 | B1 | 9/2001 | Chang et al. | |
| 6,367,180 | B2 | 4/2002 | Weiss et al. | |
| 6,367,949 | B1 | 4/2002 | Pederson | |
| 6,400,104 | B1 | 6/2002 | Ham | |
| D460,573 | S | 7/2002 | Gee | |
| 6,423,900 | B1 | 7/2002 | Soules | |
| 6,431,719 | B1 | 8/2002 | Lau et al. | |
| 6,583,571 | B1 | 6/2003 | Wang | |
| 6,883,927 | B2 * | 4/2005 | Cunningham et al. | 362/95 |
| 6,965,205 | B2 * | 11/2005 | Piepgras et al. | 315/312 |
| 7,011,422 | B2 * | 3/2006 | Robertson et al. | 362/95 |
| 7,025,473 | B2 | 4/2006 | Dokoupil | |
| 7,506,990 | B2 * | 3/2009 | Glazner | 362/95 |

(Continued)

OTHER PUBLICATIONS www.vistalighting.com/corridor2.htm, Vista Lighting: Corridor-Hospital and Institutional Lighting. "Low Profile Step Light," Aug. 2, 2003, pp. 1-72.

(Continued)

*Primary Examiner* — Jacob Y Choi
*Assistant Examiner* — Ephrem Alemu
(74) *Attorney, Agent, or Firm* — King & Spalding LLP

(57) ABSTRACT

A nightlight including a light emitting diode (LED) is provided. The nightlight includes a switch that is operative to control the flow of power to the LED. The nightlight also includes a driver circuit that is configured to convert alternating current to direct current, where the direct current provides power to the LED. The nightlight also includes a housing coupled to the nightlight that contains the driver and is configured to fit within a single-gang junction box. The switch includes an LED that is powered by the driver circuit, where the LED is illuminated without regard to the position of the switch.

15 Claims, 7 Drawing Sheets

U.S. PATENT DOCUMENTS

| | | | | |
|---|---|---|---|---|
| 7,582,911 | B2 * | 9/2009 | Lynch et al. | 362/612 |
| 7,659,672 | B2 * | 2/2010 | Yang | 315/224 |
| 2002/0159258 | A1 | 10/2002 | Beeman | |
| 2005/0063183 | A1 | 3/2005 | Swaris | |
| 2005/0077525 | A1 * | 4/2005 | Lynch et al. | 257/74 |
| 2007/0182347 | A1 * | 8/2007 | Shteynberg et al. | 315/312 |
| 2007/0267984 | A1 * | 11/2007 | Peng | 315/312 |
| 2007/0268707 | A1 * | 11/2007 | Smester | 362/362 |

OTHER PUBLICATIONS

Luxeon "Plug and Play Guide" May 2007 p. 1.

www.dansdata.com/caselight.htm, "Building a LED caselight," Jun. 22, 2003 pp. 1-19.

* cited by examiner

SWITCHED LED NIGHTLIGHT FOR SINGLE-GANG JUNCTION BOX

RELATED APPLICATIONS

This patent application claims priority under 35 U.S.C. §119 to U.S. Provisional Patent Application No. 60/932,157, titled "LED Nightlight for Electrical Receptacle," filed May 29, 2007. The complete disclosure of the above-identified priority application is hereby fully incorporated herein by reference.

TECHNICAL FIELD

The present invention relates generally to lighting devices, and more specifically to switched lighting devices that use light emitting diodes as lamps.

BACKGROUND OF THE INVENTION

The use of light emitting diodes (LEDs) in place of conventional incandescent and fluorescent lighting in consumer lighting applications has a number of advantages. LEDs tend to be less expensive and longer lasting than the conventional incandescent and fluorescent lamps. Further, conventional LEDs can output more light per watt of electricity than incandescent and fluorescent lamps.

However, the use of LEDs presents a problem. Because LEDs are biased semiconductors that only pass electricity in a single direction, and because LEDs only provide light when current passes through them, LEDs do not work properly when connected to a standard electrical power source, such as conventional 120V 60 Hz alternating current (AC), which is the power that is commonly used in residential construction throughout the United States.

Accordingly, when an AC source is used to power LEDs, additional circuitry is required to convert the AC source into direct current (DC), or a close approximation thereof, to provide power to the LEDs. This circuitry tends to be large and unwieldy, and can add size to a light fixture that employs LEDs. The space the driver circuitry requires causes problems when the LED is to be used in a very confined space, such as a conventional single-gang junction box. Indeed, conventional solutions for placing AC powered LED lights in junction boxes typically require large driver circuits to be installed in the wall or in empty neighboring junction boxes.

Both conventional solutions are undesirable. If an LED driver is placed in a second junction box (or in a double or triple-gang junction box), the driver wastes space that could be used by another outlet or switch. If the driver is installed in the wall, additional time, effort, and expense is required to install the light.

A further problem is presented by LEDs and the size of their accompanying drivers. Because of the space the driver circuitry requires, there is generally no space in the junction box for additional components such as switches. Thus, conventional LED lighting solutions do not include a self contained LED light and integrated switch unit. Such a unit, which would allow an individual to control the LED light directly from the light's location, rather than from a remote wall switch in another part of the building, can be very useful when only a small amount of light is desired and/or that light is desired for a short period of time. This need is especially acute in healthcare scenarios where healthcare professionals must constantly check on their patients at night—which generally requires reading and writing—without disturbing the patient.

Accordingly, a need exists in the art for an LED light that includes a driver circuit that is configured to fit within a single-gang junction box. A further need exists in the art for an LED nightlight having an integrated switch. Yet a further need exists in the art for the integrated switch to be illuminated so that it can be more easily located by individuals who require the use of the light.

SUMMARY OF THE INVENTION

The present invention can satisfy the above-described needs by providing a switched LED nightlight that can be powered by standard AC power and installed in a single-gang junction box. In one aspect, the present invention provides a nightlight that can include an LED. The nightlight can also include a switch that is operative to control the flow of power to the LED. The LED can be powered by a driver circuit that can be configured to convert alternating current to direct current. The driver circuit can be contained within a housing coupled to the nightlight and configured to fit within a single-gang junction box.

In one aspect, the driver circuit can include a pulse generator configured to provide power to the LED. The pulse generator can be activated in response to enabling the switch. The driver circuit can also power an LED disposed in or positioned adjacent to the switch. The LED in or adjacent to the switch can be illuminated without regard to the position of the switch.

In another aspect of the present invention, a method of providing light from a single-gang junction box is provided. The method can include the steps of providing a first LED and a switch operative to control the flow of current to the first LED, wherein a second LED can illuminate the switch. Alternating current can be received and converted to direct current. The direct current can then be supplied to the first LED and the second LED by providing the direct current to the second LED, engaging the switch, and transforming the direct current to drive the first LED. In this aspect, the switch and the first LED can be disposed in a single unit. The converting and transforming steps can be performed within a housing configured to fit within a single-gang junction box.

In yet another aspect of the present invention, a circuit operative to provide direct current to a first illumination device and a second illumination device is provided. The circuit can include a converter operative to convert alternating current into direct current. The circuit can also include a switch having an on position and an off position. The switch can also include the first illumination device. The circuit can further include a transformer operative to provide direct current to the second illumination device when the switch is in the on position. The transformer can include a primary winding and a secondary winding. In this aspect, the converter, the switch, and the transformer, can all be contained within a housing that can be configured to fit within a single-gang junction box. The first illumination device and the second illumination device can be LEDs.

Additional aspects, objects, features, and advantages of the invention will become apparent to those having ordinary skill in the art upon consideration of the following detailed description of illustrated embodiments. For a more complete understanding of the exemplary embodiments of the present invention and the advantages thereof, reference is now made to the following description in conjunction with the accompanying drawings described below.

BRIEF DESCRIPTION OF THE DRAWINGS

For a more complete understanding of the exemplary embodiments of the present invention and the advantages thereof, reference is now made to the following description in conjunction with the accompanying figures briefly described as follows.

DETAILED DESCRIPTION OF THE EXEMPLARY EMBODIMENTS

The present invention provides a switched LED nightlight that generates light using one or more LEDs. The switched nightlight includes LED driver circuitry that receives alternating current, which is converted into direct current to drive the LEDs. The switched nightlight is configured such that the nightlight, the switch, and the LED driver circuitry can be installed into a standard single-gang junction box. While the specification describes the exemplary embodiment of a switched LED nightlight, the present invention is capable of providing light for a wide variety of applications wherein it is desirable to have a single, self-contained, switched lighting unit that can be installed in a single-gang junction box.

The term "lamp" refers generally to an apparatus for providing light, such as, for example, LEDs, incandescent lamps, compact fluorescent lamps, fluorescent lamps, or other apparatuses that provide light. The term "housing" refers to a casing or other enclosure that contains circuitry, switches, and/or other components that allow, or assist in, the functioning of the light. The term "junction box" refers generally to a container or enclosure for electrical connections. The term "single-gang junction box" refers to a junction box that is configured to receive a single electrical component, such as a switch or electrical outlets, and to accommodate the connection of that electrical component to a power supply. Any spatial references herein such as, for example, "upper," "lower," "above," "below," "rear," "between," "vertical," "angular," "beneath," etc., are for the purpose of illustration only and do not limit the specific orientation or location of the described structure.

Figure 1:
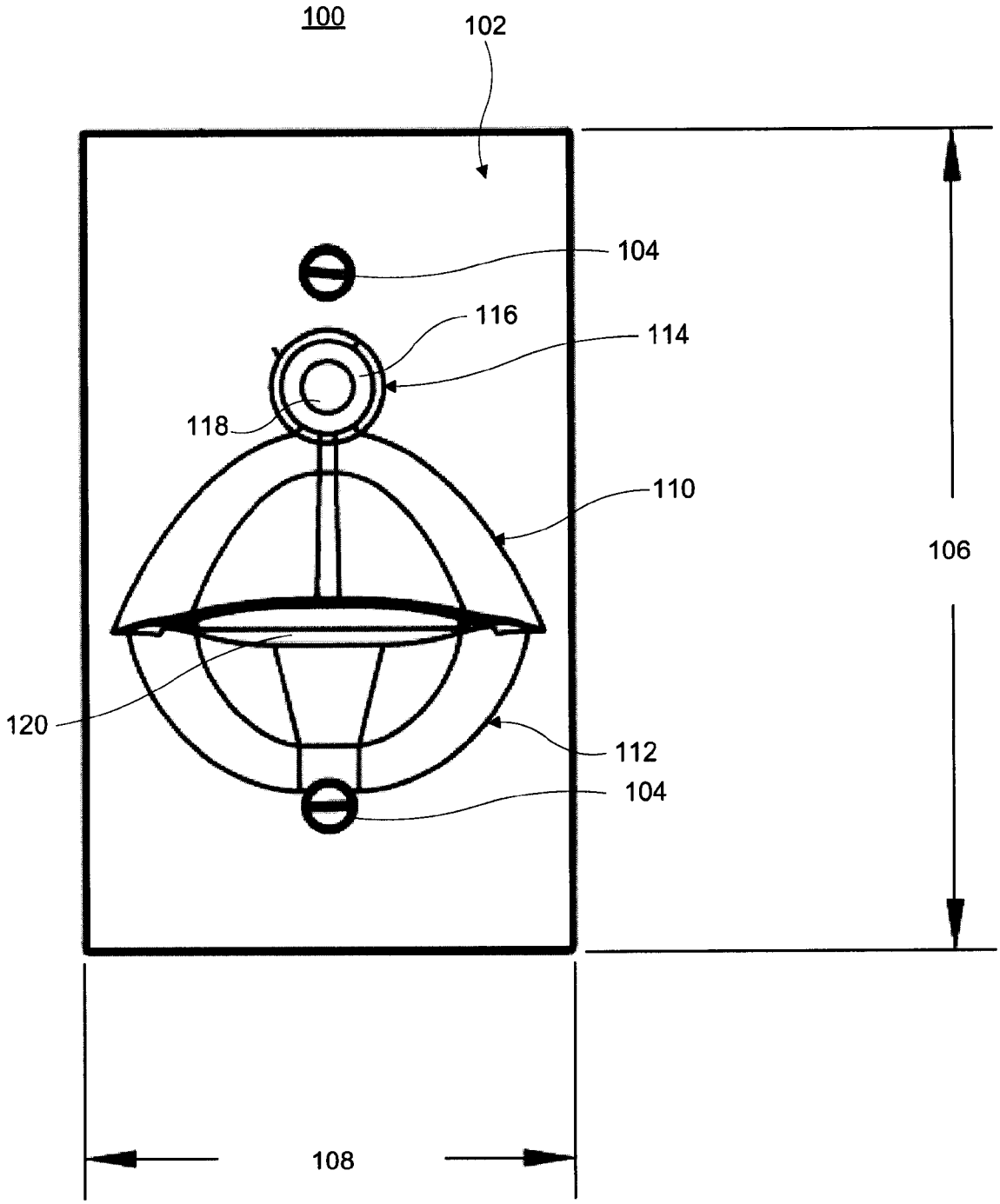
FIG. 1 is a front view of a switched LED nightlight according to certain exemplary embodiments of the present invention.

Referring now to the figures, in which like numerals represent like elements throughout the figures, exemplary embodiments of the present invention will be described. FIG. 1 is a front view of a switched LED nightlight 100 according to certain exemplary embodiments of the present invention. Referring now to FIG. 1, the exemplary switched LED nightlight 100 includes a front plate 102 that is coupled to a single-gang junction box (not shown) with fasteners that extend through fastener openings 104. Conventionally, the fasteners are screws which are sized and threaded according to the junction box manufacturer's specifications. The coupling of the front plate 102 to a single-gang junction box is shown in greater detail with respect to FIG. 5.

The front plate 102 is sized to conceal the junction box attached to the nightlight 100, and accordingly has a height 106 and a width 108 that are greater than that of the junction box. In one exemplary embodiment, the height 106 and width 108 are five (5) inches and three (3) inches, respectively, which is sufficient to conceal a conventional single-gang junction box. In an alternative embodiment, however, the front plate 102 can have a variety of heights and widths, depending on the desired visual characteristics of the nightlight 100. For example, the front plate 102 can be much larger than the junction box it conceals. Typically, the junction box is installed in a wall (not shown), and the front plate 102 is installed in the junction box such that the back of the front plate 102 is flush with the wall.

The front plate 102 is configured to accommodate an illumination device, or lamp 120. In one exemplary embodiment, the lamp 120 includes an array of six LEDs. In an alternative embodiment, the illumination device can be any device that provides light and is powered by direct current, including, but not limited to, additional (or fewer) LEDs, organic light emitting diodes, incandescent lamps, or compact fluorescent lamps.

Figure 7:
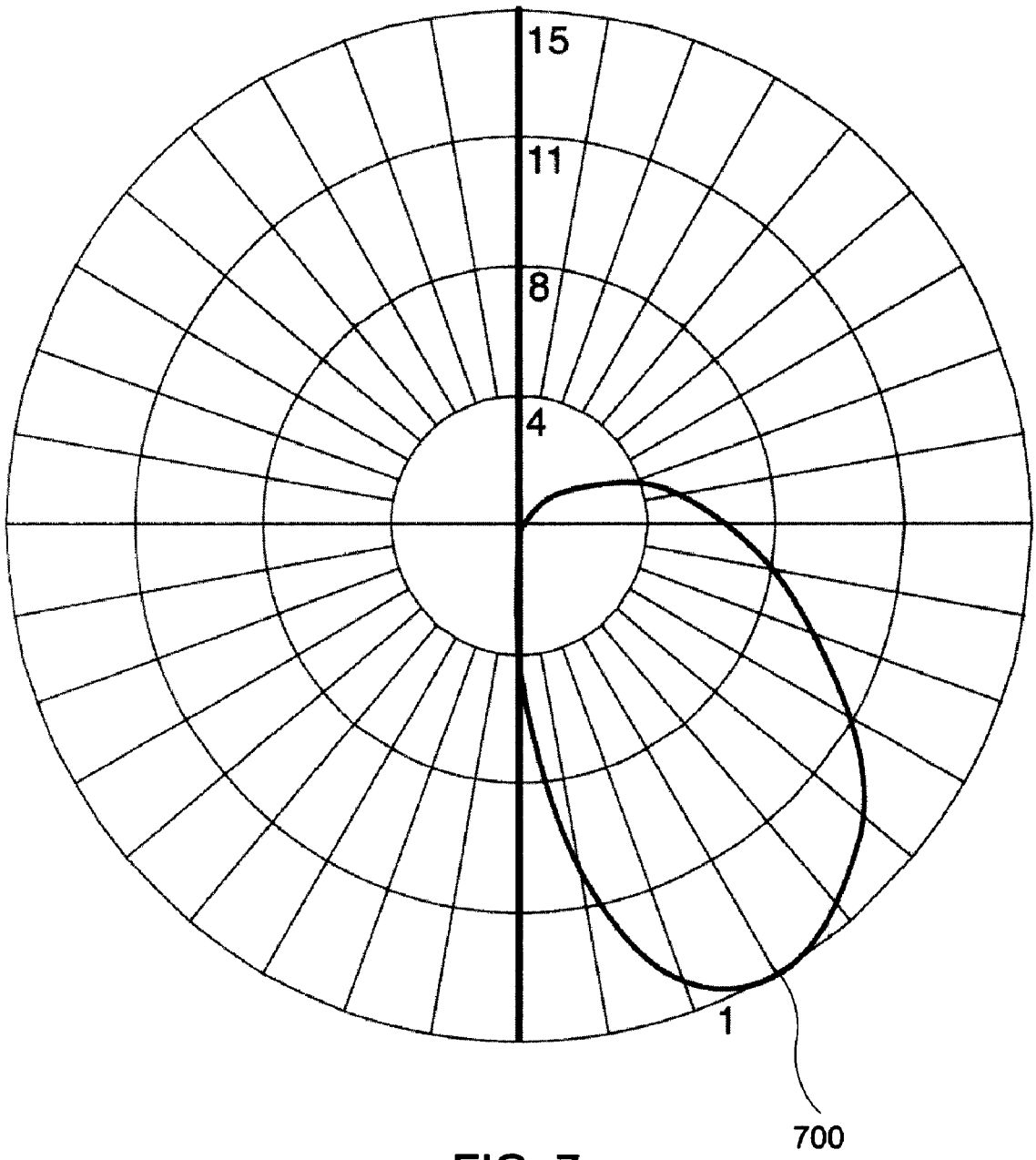
FIG. 7 provides an exemplary photometric distribution for the light provided by the switched LED nightlight of FIG. 1.

In one exemplary embodiment, the front plate 102 accommodates the lamp 120 within a hood member 110. The exemplary hood member 110 extends outward from the front plate 102 (away from the wall) in a substantially arched manner, as illustrated in FIGS. 1-5. The hood member 110 creates a cavity that diffuses and directs light downward from the lamp 120, and prevents light from traveling upward. By controlling light in this way, the hood member 110, in conjunction with the LEDs, creates a focused area of illumination that is suitable for activities that require light—such as reading. The hood member 110 also prevents light from being distributed over a wide area, thereby reducing the likelihood that the light will, for example, disturb an individual sleeping in a darkened room. The light distribution from the exemplary embodiment is illustrated in FIG. 7.

In an alternative embodiment, the hood member 110 can be of any appropriate shape and size to direct light from the lamp 120 in at least one direction while preventing or reducing light transmission in another direction. In an additional alternative embodiment, the hood member 110 can be absent, or can be replaced with a transparent or semi-transparent lens that allows light to emanate more broadly from the lamp 120.

The front plate 102 also includes a depression 112 disposed adjacent to the lamp 120. The depression 112 creates a larger opening for directing light from the LEDs without enlarging the distance the hood member 110 protrudes from the front plate 102. The exemplary depression 112 extends inward with respect to the front plate 102 (toward the wall), and is shaped substantially inversely to the hood member 110. In an alternative embodiment, the depression 112 can be smaller or larger, or shaped differently than the hood member 112.

The front plate 102 also includes an opening 114 configured to accept a switch 116 disposed therein. The switch is configured to control the flow of electricity to the lamp 120. In one exemplary embodiment, the switch 116 is a push-button switch. In an alternative embodiment, the switch 116 can be any switching mechanism suitable for controlling the flow of electricity to the lamp 120 including, but not limited to, a toggle switch, a conventional surface mount switch, a momentary switch, or a biased switch.

Further, in one exemplary embodiment, the push-button switch is made of translucent or transparent plastic, and includes a lamp on one side of the translucent or transparent plastic, wherein light emanating from the lamp can be seen on the other side of the plastic. The switch lamp can be constantly illuminated without regard to the position of the switch 116. By being constantly illuminated, a person desiring to turn the nightlight 100 on in an otherwise darkened room is able to easily find the switch 116. The button can further be colored to reduce the impact light emanating from the switch can have on the overall level of light in the room. In one exemplary embodiment, the button can be green, although other colors such as red, blue, yellow, orange, and variations thereof are contemplated. The opening 114 includes a hole 118 that extends through the front plate 102 to allow the switch 116 to be wired to the lamp 120.

Figure 2:
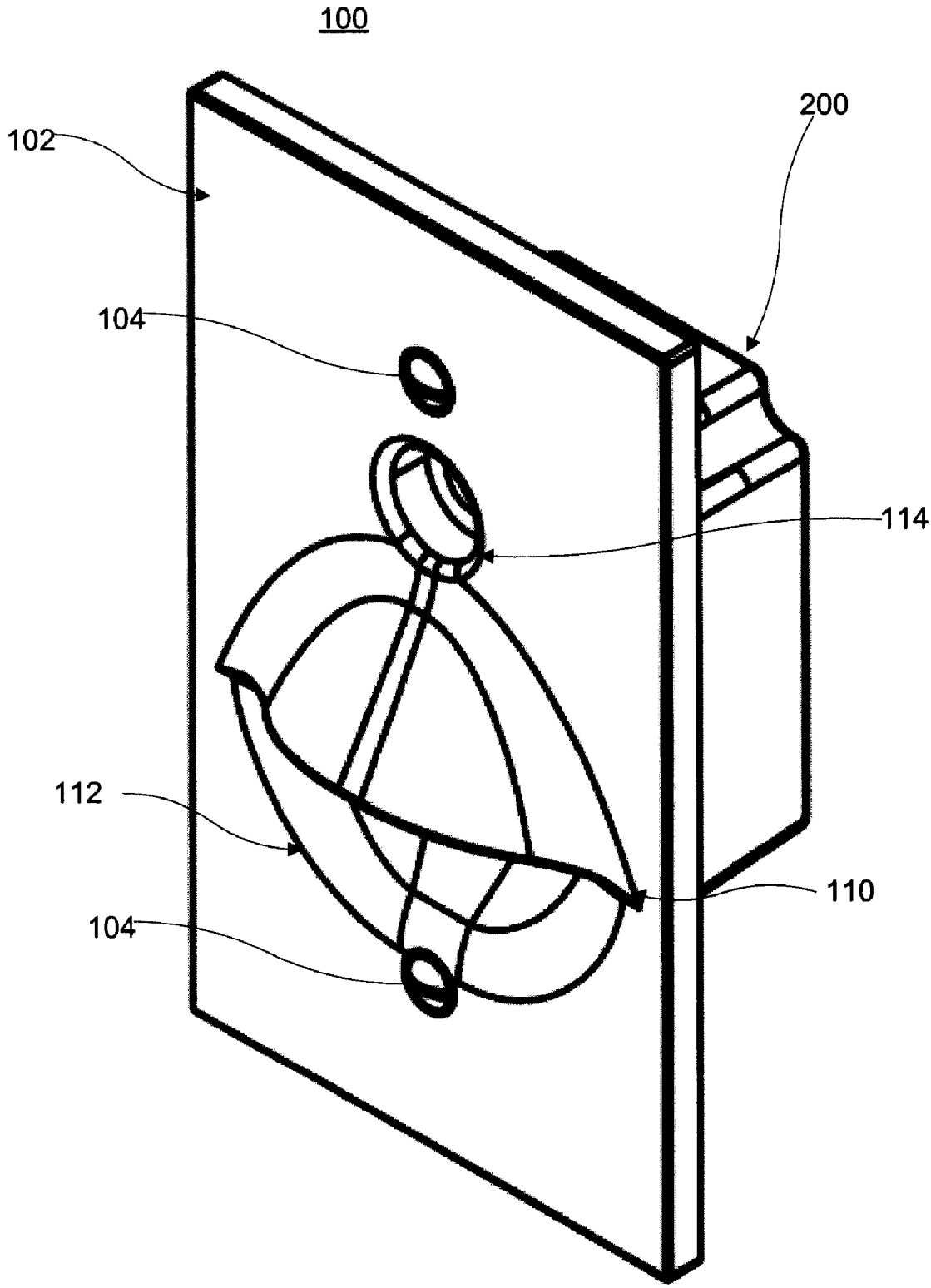
FIG. 2 is an elevated perspective view of the switched LED nightlight of FIG. 1 according to certain exemplary embodiments of the present invention.

FIG. 2 is an elevated perspective view of the switched LED nightlight 100 of FIG. 1 according to certain exemplary embodiments of the present invention. Now referring to FIG. 2, the housing 200 contains the driver circuitry for the lamp 120. As will be described in greater detail with respect to FIGS. 3-5, in one exemplary embodiment, the housing 200 is configured to contain all of the components necessary to provide power to the lamps, both the switch 116 lamp and the primary lamp 120. Further, the housing 200 is configured to fit within a single-gang junction box, while leaving space within the junction box to allow for wiring connections between the nightlight 100 and source power.

In one exemplary embodiment, the housing 200 is constructed from plastic. In alternative embodiments, however, the housing 200 can be constructed from any material that provides suitable electrical isolation for the components inside the housing 200 with respect to items disposed outside of the housing 200.

In one exemplary embodiment, the housing 200 is coupled to the front plate 102 using fasteners, such as screws, bolts, or rivets. In an alternative embodiment, the housing 200 can be coupled to the front plate 102 using an adhesive such as epoxy, glue, a weld, or other conventional means.

Figure 3:
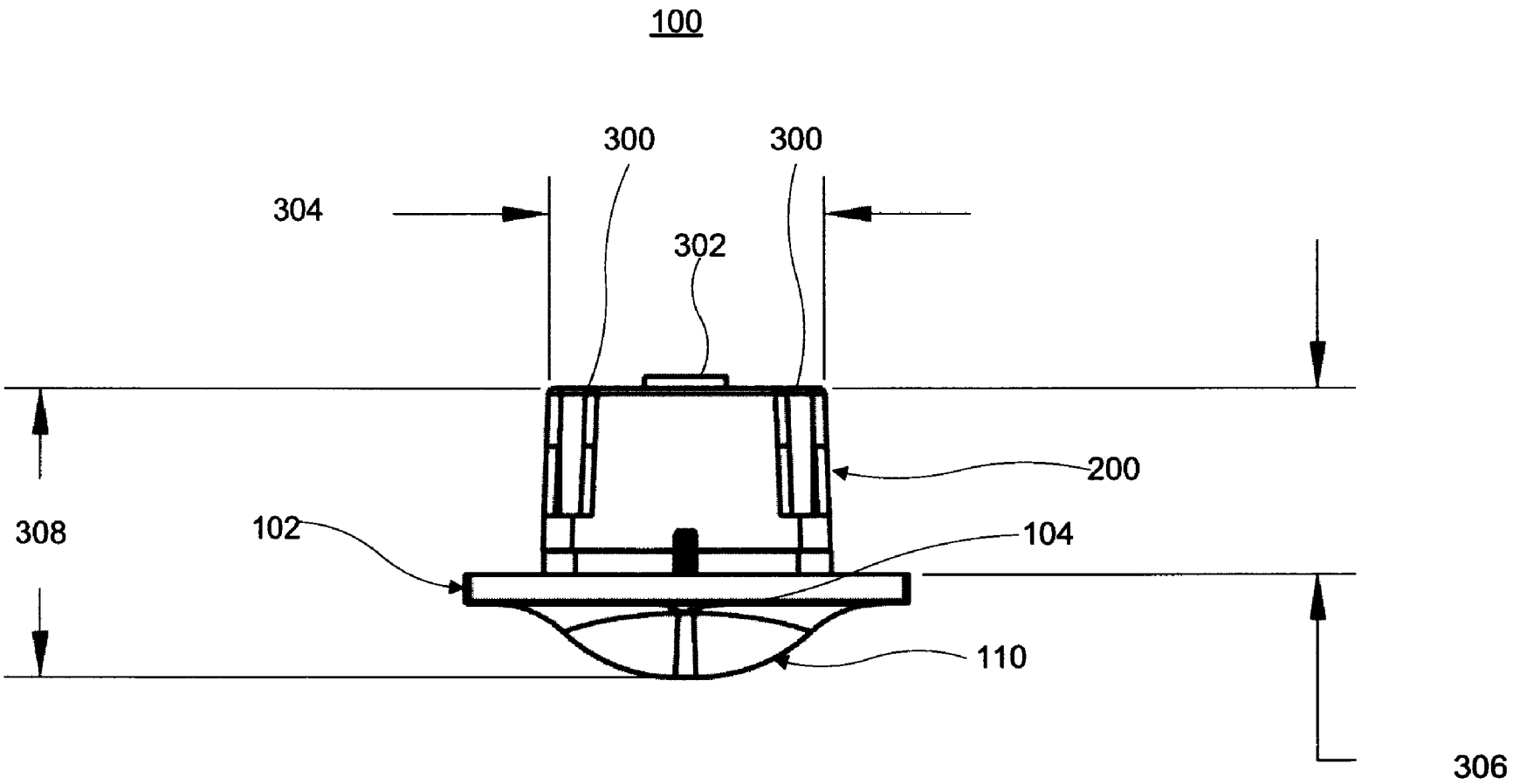
FIG. 3 is a top view of the switched LED nightlight of FIG. 1 according to certain exemplary embodiments of the present invention.
Figure 4:
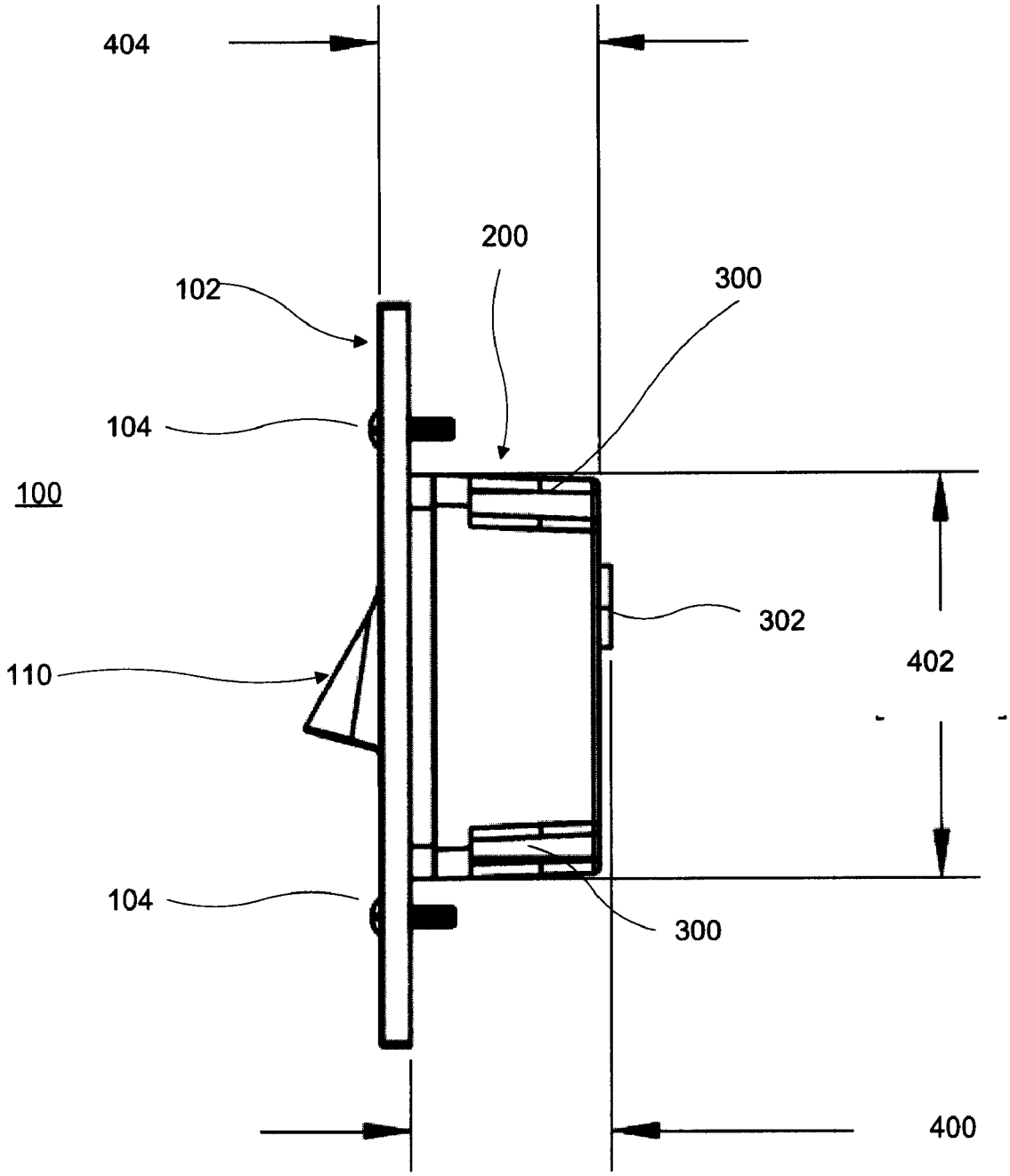
FIG. 4 is a side view of the switched LED nightlight of FIG. 1 according to certain exemplary embodiments of the present invention.
Figure 5:
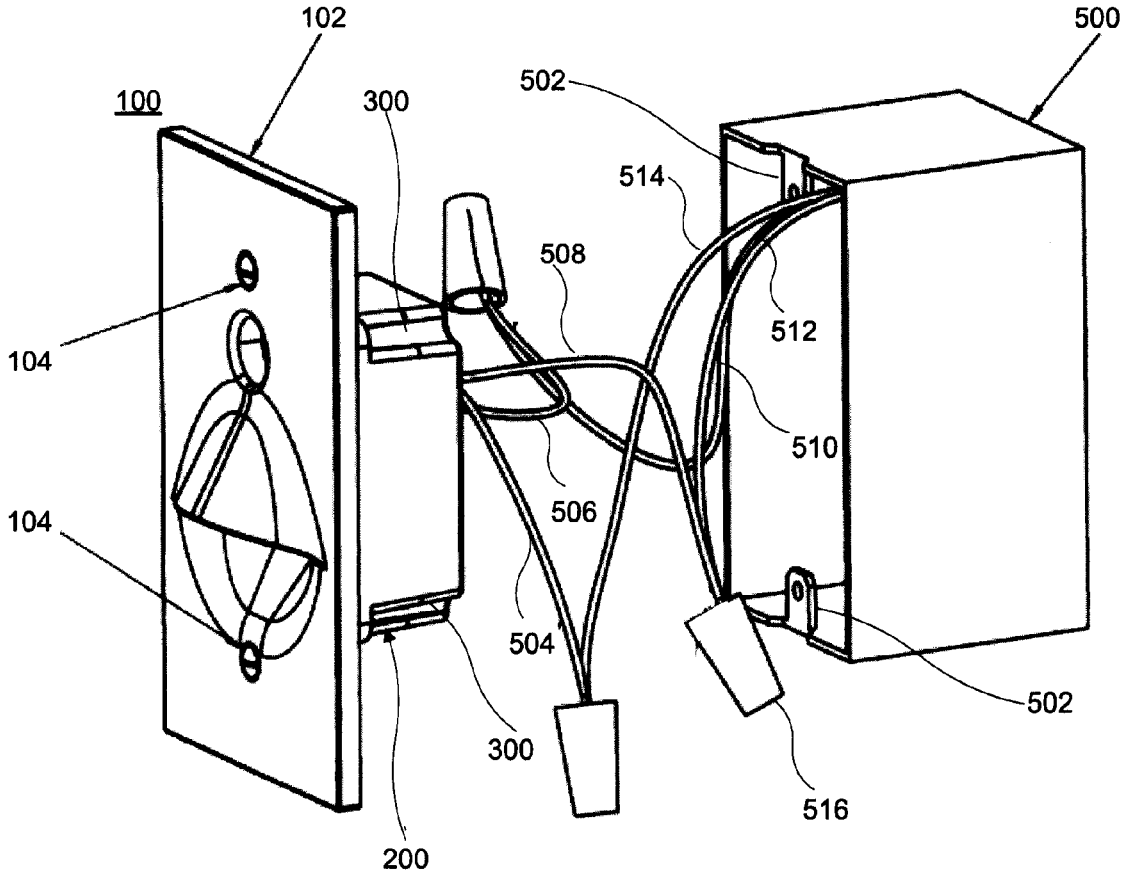
FIG. 5 is an exploded view of the switched LED nightlight of FIG. 1 being installed in a single-gang junction box according to certain exemplary embodiments of the present invention.

FIGS. 3-5, discussed below, provide additional details and dimensions for the housing 200 and the nightlight 100. The described dimensions are exemplary dimensions for a housing 200 that fits within a single-gang junction box, and are not the only possible dimensions for the housing 200. The exemplary housing 200 can be of various sizes and shapes and still fit within a single-gang junction box. Any such housing 200 is within the scope of the present invention.

FIG. 3 is a top view of the switched LED nightlight 100 of FIG. 1 according to certain exemplary embodiments of the present invention. FIG. 3 also provides further illustration of the shape of one exemplary embodiment of the hood member 110.

Figure 6:
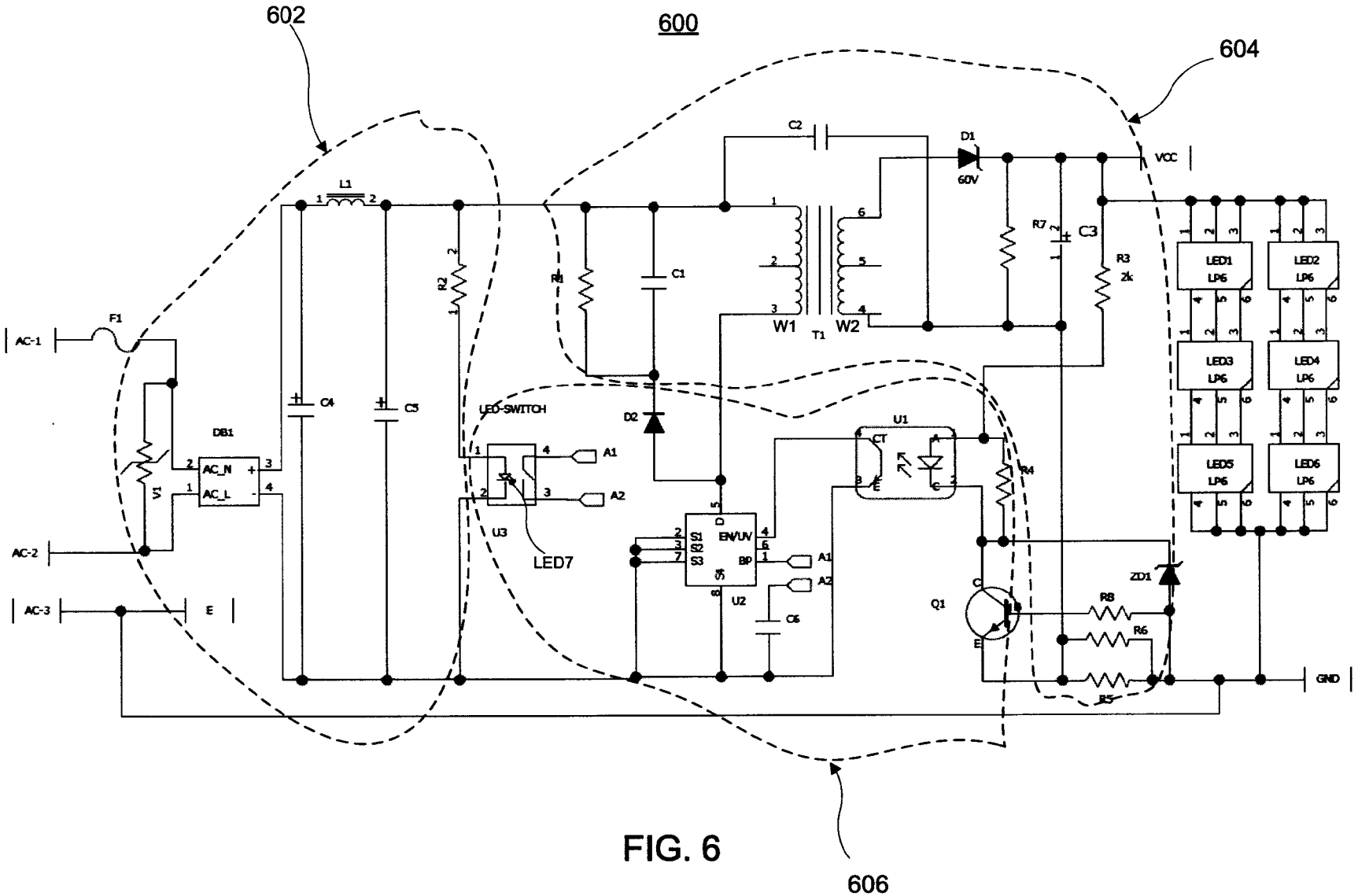
FIG. 6 is a diagram of a driver circuit for a switched LED nightlight according to certain exemplary embodiments of the present invention.

FIG. 3 provides further detail with respect to the configuration of the housing 200. Now referring to FIG. 3, the exemplary housing 200 has four corner openings 300 (two are shown in FIG. 3) that facilitate connection of the housing 200 to the front plate 102 using fasteners. The corner openings 300 are rounded cutouts having chamfered corners. The corner openings 300 further include fastener openings (not shown) that accept a fastener that couples the housing 200 to the front plate 102. In one exemplary embodiment, the housing 200 includes a tension relief member 302 that assists in preventing a force applied to the nightlight's power supply cables (as shown in FIG. 6) from damaging components inside the housing 200 by holding the cables in place. In an alternative embodiment, the tension relief member 302 can not be present.

The housing 200 has a width 304, and extends a distance 306 from the front plate 102. In one exemplary embodiment, the width 304 is 1.863 inches, and the distance 306 from the front plate 102 is 1.272 inches. The nightlight 100 has a total depth 308 from the end of the hood member 110 to the end of the housing 200. In one exemplary embodiment, the total depth 308 is 1.972 inches.

FIG. 4 is a side view with additional exemplary dimensions of the switched LED nightlight 100 of FIG. 1 according to certain exemplary embodiments of the present invention. Referring now to FIG. 4, the housing 200 has a depth 400 from the front plate 102 to the end of the tension relief member 302, and a depth 404 from the front portion of the front plate 102 to the end of the housing 200. In one exemplary embodiment, the depth 400 is 1.352 inches, and the depth 404 is 1.472 inches. The housing 200 also has a height 402, which, in one exemplary embodiment, is 2.688 inches.

FIG. 5 is a perspective view of a switched LED nightlight 100 of FIG. 1 being installed in a single-gang junction box 500 according to certain exemplary embodiments of the present invention. Referring now to FIG. 5, the nightlight 100 has leads 504, 506, and 508 extending from the housing. The leads 504, 506, and 508 are used to connect the nightlight 100 to a standard alternating current power supply (not shown). The leads 504, 506, and 508 are conventionally referred to as live (or hot), neutral, and ground (or Earth) leads. The leads 504, 506, and 508 are coupled via conventional means 516, such as, for example, twist-on wire connectors, to the corresponding leads 510, 512, and 514, which are electrically coupled to the power supply. In an alternative embodiment, only two leads are connected to the power supply, and the ground lead is coupled to a grounded object such as a post, or to a post or other conductive member on the housing 200.

Once coupled, the housing 200 and leads 504, 506, 508, 510, 512, and 514 are inserted into the single-gang junction box 500, the fasteners are inserted through the fastener openings 104 in the front plate 102 and are fastened to the fastener holes 502 in the junction box 500.

FIG. 6 is a diagram of a driver circuit 600 for a switched LED nightlight 100 of FIG. 1 according to certain exemplary embodiments of the present invention. Referring now to FIGS. 1 and 6, the driver circuit 600 converts alternating current into a direct current supply that is capable of providing direct current both to the lamp illuminating the switch 116 and to the primary nightlight lamp 120. Furthermore, the circuitry in the driver circuit 600 is configured to fit on a printed circuit board (PCB) capable of being disposed within the housing 200 described above with respect to FIGS. 3-5. The driver circuit 600 has three major components: an initial AC/DC conversion circuit 602, an LED driver circuit 604, and a switch circuit 606.

The initial AC/DC conversion circuit 602 transforms alternating current from an AC power supply AC-1, AC-2, and AC-3 (where AC-3 is connected to ground) to DC power. The current from the power supply is directed through a fuse F1 that protects the driver circuit 600 from abnormal voltage conditions. The AC current then passes through varistor V1, which provides surge suppression for the driver circuit 600. The AC current then passes through bridge rectifier DB1, which converts the 120V AC current to a rectified AC signal. The resulting rectified signal is then filtered to a suitable level to provide power to the LED-SWITCH (LED-SWITCH is the circuitry underlying the switch 116) with capacitors C4 in conjunction with inductor L1, and smoothed with capacitor C5. The filtering and smoothing results in a near-DC signal that is suitable for driving the LED (LED7) in the LED-SWITCH. The near-DC signal is then provided to LED7, which in an exemplary embodiment, is illuminated without regard to the position of the switch 116.

The LED driver circuit 604 is used to provide DC current to the nightlight lamp 120, which, in one exemplary embodiment, is an array of six LEDs LED1-LED6. The LED driver circuit 604 receives pulses of direct current across transformer T1. The pulses of direct current are then delivered across Zener diode D1, which ensures that only forward-biased current flows across the lamp LED1-LED6. The pulses are received on the primary winding W1 of the transformer T1, and delivered to the lamp LED1-LED6 by the secondary winding W2 of the transformer T1. The pulses are smoothed with capacitor C3, which then delivers a near-DC signal to the lamp LED1-LED6.

In one exemplary embodiment, no current will flow across the transformer T1 unless the switching circuitry 606 is engaged. The switching circuitry 606 includes a pulse generator U2 which provides pulses across the primary winding W1 of the transformer T1. Whenever pulses are delivered to the primary winding W1 of the transformer T1, a current is generated in the secondary winding W2, which flows to the lamp LED1-LED6.

In one exemplary embodiment, the switching circuitry is controlled in two ways. First, optocoupler U1 is configured such that the optocoupler's U1 LED will illuminate when voltage across the lamps LED1-LED6 exceeds a predetermined threshold. When the LED of optocoupler U1 is illuminated, the optocoupler pulls the enable pin EN of the pulse generator U2 low, disabling the pulse generator U2 until voltage across the lamp LED1-LED6 falls to a level below the predetermined threshold, disabling the optocoupler U1, and enabling the pulse generator U2. In an exemplary embodiment, the threshold is the voltage drop across the series of LEDs LED1, LED3, and LED5.

Second, the pulse generator U2 is connected to the LED-SWITCH. When the LED-SWITCH is engaged, the pulse generating chip functions normally. However, in one exemplary embodiment, the pulse generator U2 is designed to stop producing pulses when the voltage on bypass pin B falls below a predetermined threshold. Accordingly, when the LED-SWITCH is disengaged, the connection to bypass pin B is opened and the voltage on bypass pin B drops to zero, which is below the predetermined threshold. This causes U2 to stop producing pulses.

FIG. 7 provides a photometric distribution for the light provided by the switched LED nightlight 100 of the present invention. Referring now to FIGS. 1 and 7, as illustrated by the plot 700, light from the nightlight 100 is primarily directed downward from the lamp 120. Table 1, below, provides zonal lumen summary data for one exemplary embodiment of the nightlight 100 of the present invention.

TABLE 1

| Zone | Lumens | % Fixture |
|---|---|---|
| 0-30 | 4.71 | 15.5 |
| 0-40 | 8.44 | 27.8 |
| 0-60 | 16.85 | 55.6 |
| 0-90 | 12.88 | 85.4 |
| 0-180 | 30.31 | 100.0 |

Based on the foregoing, it can be seen that the present invention provides a switched LED nightlight capable of being entirely positioned within a single-gang junction box. The present invention also provides a system and method for converting alternating current to direct current such that a nightlight using LED lamps can include an illuminated switch, and the nightlight assembly will fit into a single-gang junction box. Many other modifications, features and embodiments of the present invention will become evident to those of ordinary skill in the art. It should be appreciated, therefore, that many aspects of the present invention were described above by way of example only and are not intended as required or essential elements of the invention unless explicitly stated otherwise. Accordingly, it should be understood that the foregoing relates only to certain exemplary embodiments of the invention and that numerous changes can be made therein without departing from the spirit and scope of the invention as defined by the following claims.

What is claimed is:

1. A system for emitting light, comprising:

a faceplate comprising an outward facing side and an opposing inward facing side and configured to be coupled to a single gang junction box;

a light emitting diode (LED) disposed along the inward facing side of the faceplate;

a hood disposed on and extending outward from the outward facing side of the faceplate;

a depression formed in the outward facing side of the faceplate and extending inward with respect to the faceplate, wherein the depression is disposed substantially below and adjacent the hood and wherein the hood and the depression are configured to reflect light emitted by the LED;

wherein the hood and the depression define an opening through which light is emitted by the LED into a room environment;

a driver circuit electrically coupled to the LED, wherein the driver circuit is configured to receive alternating current and convert it to direct current, and wherein the direct current is operative to provide power to the LED, wherein the driver circuit is configured to fit within a single-gang junction box.

2. The system of claim 1, wherein the driver circuit further comprises a pulse generator configured to provide power to the LED.

3. The system of claim 1, wherein the faceplate further comprises at least one fastener opening disposed through the faceplate, wherein the fastener opening is configured to receive a fastener to couple the nightlight to the junction box.

4. The system of claim 1, further comprising a housing coupled to the inward facing side of the faceplate, wherein the driver is disposed within the housing and the housing is configured to fit in the single-gang junction box.

5. The system of claim 1, wherein the LED comprises an LED array.

6. A system for emitting light, comprising:

a faceplate comprising an outward facing side and an opposing inward facing side and configured to be coupled to a single gang junction box;

a light emitting diode (LED) disposed along the inward facing side of the faceplate;

a hood disposed on and extending outward from the outward facing side of the faceplate;

a depression formed in the outward facing side of the faceplate and extending inward with respect to the faceplate, wherein the depression is disposed substantially below and adjacent the hood and wherein the hood and the depression are configured to reflect light emitted by the LED;

wherein the hood and the depression define an opening through which light is emitted by the LED into a room environment;

a switch electrically coupled to the LED and operative to control the flow of power to the LED;

a driver circuit electrically coupled to the LED and the switch, wherein the driver circuit is configured to receive alternating current and convert it to direct current, and wherein the direct current is operative to provide power to the LED, wherein the driver circuit and the switch are contained in a single-gang junction box.

7. The system of claim 6, wherein the driver circuit further comprises a pulse generator configured to provide power to the LED, wherein the pulse generator is enabled in response to enabling the switch.

8. The system of claim 6, wherein the LED comprises an LED array.

9. The system of claim 6, wherein the faceplate further comprises at least one fastener opening disposed through the faceplate, wherein the fastener opening is configured to receive a fastener to couple the nightlight to the junction box.

10. The system of claim 6, further comprising a housing coupled to the inward facing side of the faceplate, wherein the driver is disposed within the housing and the housing is configured to fit in the single-gang junction box.

11. The system of claim 6, wherein the switch comprises an outward facing side and an inward facing side and wherein the system further comprises a second LED disposed adjacent the inward facing side of the switch.

12. The system of claim 11, wherein the driver circuit is electrically coupled to the second LED and configured to provide power to the second LED.

13. The system of claim 11, wherein the second LED is configured to emit light through at least a portion of the inward and outward facing sides of the switch into the room environment.

14. The system of claim 11, wherein illumination of the second LED is independent of the position of the switch.

15. The system of claim 14, wherein the second LED is always illuminated.

* * * * *